US005989488A

United States Patent [19]

Hori

[11] Patent Number: 5,989,488

[45] Date of Patent: Nov. 23, 1999

[54] BLAST TUYERE OF A BLAST FURNACE

[75] Inventor: Ryuichi Hori, Kakogawa, Japan

[73] Assignee: Kabushiki Kaisha Kobe Seiko Sho, Kobe, Japan

[21] Appl. No.: 09/239,970

[22] Filed: Jan. 29, 1999

[30] Foreign Application Priority Data

Jan. 30, 1998 [JP] Japan ..... 10-018815

[51] Int. Cl.[6] ..... C21B 7/16

[52] U.S. Cl. ..... 266/270; 266/265

[58] Field of Search ..... 266/265, 268, 266/270

[56] References Cited

U.S. PATENT DOCUMENTS 613,042 10/1898 Killeen ..... 266/270
4,898,368 2/1990 Schaffer et al. ..... 266/270

OTHER PUBLICATIONS

French Patent Abstract FR002549489A1, Jan. 1985.
Japanese Patent Abstract JP356086678A, Jul. 1981.

*Primary Examiner*—Scott Kastler

*Attorney, Agent, or Firm*—Oblon, Spivak, McClelland, Maier & Neustadt, P.C.

[57] ABSTRACT

A blast tuyere of a blast furnace making it possible that the temperature of Cu of the outer surface of the tuyere is not overheated to its melting point or higher so as to prevent tuyere failure and endure long-term use. This tuyere comprises a tuyere trunk 1 having a cooling chamber 2 of a tuyere body and a cooling chamber 3 of a tuyere nose. At least the upper half of the whole of the outer circumference surface of a portion being in the tuyere trunk and projecting into the blast furnace, or the whole excluding the forefront of the outer circumference surface is coated with a shell layer 5 made of a material having a higher melting point than the melting point of Cu and temperature of a hot metal in the blast furnace. Furthermore, a jacket 4 made of a metal for protecting the tuyere from mechanical impacts received at the time of inserting the tuyere into the blast furnace is fitted onto the outside of the shell layer.

11 Claims, 2 Drawing Sheets

BLAST TUYERE OF A BLAST FURNACE

BACKGROUND OF THE INVENTION

1. Field of the Invention

The present invention relates to a blast tuyere of a blast furnace such as a blast furnace for manufacturing iron, a blast furnace for manufacturing nonferrous metals, and a cupola.

2. Related Art

A blast tuyere (referred to as a tuyere hereinafter) of a blast furnace is usually installed in the vicinity of the boundary between the belly and the bottom of the blast furnace, and in many cases a portion of 400–600 mm length at the tip side of the tuyere is projected into the blast furnace. A cool blast or a hot blast is blown from the tip portion (nose) to the inside of the blast furnace. The highest temperature of the hot blast reaches 1250° C., and the highest temperature of the flame in front of the tuyere rises up to 2450° C. Moreover, the interior of the furnace is in the state that pig iron melted at 1500° C. or higher and slag are dropped.

Under such a severe temperature condition, any tuyere must keep its original form and simultaneously cause a hot blast to continue to blow. In the present technology, therefore, a tuyere is made of highly pure copper (Cu) having a high heatproof temperature and a good heat conductivity. In addition, a circular flowing route for cooling-water is formed in the body of the tuyere, and water is permitted to flow in the circular flowing route at a high flowing speed to cool the tuyere, as is known in Japanese Utility Model Application Laid-Open No. 3-29310, as well.

Since the birth of a blast furnace, however, damage of tuyeres has come into question to be solved. In other words, when the method for cooling tuyeres is improved, the operation conditions of blast furnaces become more severe accordingly so as to induce damage of the tuyeres, and that this predicament has been repeated. The following will broadly describe the history about the improvement in tuyeres of blast furnace.

About 70 years ago, Mr. Hirakawa stated that the cause of the damage of a tuyere is "superheat by contact between the tuyere and a hot metal", and reported, as a countermeasure against the cause, that aluminum (Al) is satisfactory as a material of a tuyere since "a material having a large thermal resistance (thickness/thermal conductivity) and a smooth surface is suitable for the material of the tuyere" and that "an Al tuyere is superior to Cu in workability (light weight) as well as resistance against tuyere failure" (see "Iron and Steel" Vol. 16(1930) No. 6, p. 595). However, Al tuyeres were frequently damaged. Thus, Cu tuyeres have been used since about 1950.

Since about 1960, blast furnace operation has been corresponding to the fact that furnaces have become large-scale. Thus, in those days high pressure operation, high temperature blast, oil injection and oxygen enrichment started. Furthermore, in about 1980, pulverized coal injection started. With such high productivity operation, temperature of the space in front of a tuyere was raised by a rise in temperature of hot blast and injection of a burning aid agent and oxygen. Moreover, the drop amount of hot metal or slag was remarkably increased by improvement in productivity. Based on such causes, thermal load on the tuyere was greatly increased. As a result, tuyere failure frequently occurred again. Once a tuyere is damaged, it is essential that blowing-down is carried out and the tuyere is exchanged. Thus, the reduced amount of production is larger. In the worst case, it is feared that an accident resulting in injury or death happens by serious damage of the tuyere and furnace operation becomes in a bad condition or impossible by invasion of tuyere-cooling-water into a furnace. Accordingly, various improvements have been made, from the standpoint of necessity of preventing tuyere failure.

Incidentally, tuyere failure is classified into 7 types, that is, failure in the upper portion, the two side portions and the lower portion of the outer surface of the tuyere body; the upper portion, the two side portions and the lower portion of the tuyere nose; and the inner surface of the tuyere body.

Recent improved countermeasures against such failure are as follows:

(1) a two chamber type tuyere structure wherein a cooling chamber (for a body chamber) of a tuyere body, and a front cooling chamber and a rear cooling chamber (each of which is for a nose chamber) of a tuyere nose are separately disposed inside the trunk of the tuyere (Japanese Patent Application Publication No. 60-55562), (2) a spiral tuyere structure for causing water to flow from the body of a tuyere trunk, through an outer cooling-water chamber, a spiral passage, and a front circular passage, to an inner cooling-water chamber and further to be discharged from the body of the tuyere trunk, so as to raise the speed of the cooling-water, in particular, at a tuyere nose(Japanese Patent Application Publication No. 51-19802), (3) hard-facing structure for preventing wear at a tuyere nose (Japanese Utility Model Application Laid-Open No. 55-124446), (4) alloy padding structure for raising melting temperature (Japanese Utility Model Application Laid-Open No. 4-131639), (5) inner face ceramic lining processing for preventing the inner face of a tuyere from being failed and worn (Japanese Patent Application Publication No. 6-60333), and the like. At present improved means comprising a single from them or a combination of them are adopted.

As a result, the failure in the inner face of a tuyere hardly arises by the inner face ceramic lining processing. Furthermore, the frequency of failure in the nose of the tuyere can greatly be reduced by both cooling-water having high pressure and speed and the hard-facing.

However, the frequency of failure in the outer surface of the tuyere body, particularly the upper portion of the outer surface, is not reduced even by such improved means. This is because the drop of a hot metal of 1500° C. or more falls, from the upper part of a furnace, directly onto the outer surface of the tuyere body, so that the drop contacts Cu constituting the tuyere and causes the Cu to be melted.

Of course, in this case, even if hot melt slag of 1500° C. or more drops from just above the tuyere, the tuyere is not damaged in the case wherein the upper surface of the tuyere body is not heated to the melting point of Cu or higher. Furthermore, even if the fluid surface level of the hot metal or slag rises so that the fluid of 1500° C. or higher contacts the lower surface of the tuyere body, the tuyere is not damaged in the case wherein the tuyere body is not heated to the melting point of Cu or higher. At present, however, there is not realized a cooling means for, even if the hot metal or slag contacts the tuyere directly, keeping the temperature of the contacted portion of the tuyere below the melting point. Thus, there remains a problem that the frequency of failure in the outer surface of the tuyere body is still high.

SUMMARY OF THE INVENTION

The present invention has been made to overcome the above-mentioned problems of conventional tuyeres.

Therefore, the present invention aims to provide a blast tuyere of a blast furnace for not overheating the temperature of Cu of the outer surface of the tuyere to its melting point or higher so as to prevent tuyere failure and endure long-term use.

In order to attain this object, the present invention is as follows:

In a blast tuyere of a blast furnace of the present invention comprises a tuyere trunk having a cooling chamber of a tuyere body and a cooling chamber of a tuyere nose, at least the upper half of the whole of the outer circumference surface of a portion, being in said tuyere trunk and projecting into said blast furnace, or the whole excluding the forefront of said outer circumference surface is coated with a shell layer made of a material having a higher melting point than the melting point of Cu and temperature of a hot metal in said blast furnace, and a jacket made of a metal for protecting said tuyere from mechanical impacts received at the time of inserting said tuyere into said blast furnace is fitted onto the outside of said shell layer.

In a preferred embodiment, said shell layer is made of a ceramic having a high resistance against hot metal or slag.

In a preferred embodiment, said shell layer is made of highly purified alumina.

In a preferred embodiment, said shell layer has a thickness of 5–10 mm.

In a preferred embodiment, studs for improving adhesion between said tuyere trunk and said shell layer are scattered and disposed on the outer circumference surface of a portion being in said tuyere trunk and contacting said shell layer.

In a preferred embodiment, a slightly uneven surface for improving adhesion between said tuyere trunk and said shell layer is formed as the outer circumference surface of a portion being in said tuyere trunk and contacting said shell layer.

According to the above-mentioned present invention, the tuyere inserted into a blast furnace never fails because the tuyere trunk is kept at relatively low temperatures that are the melting point of Cu or lower even at high temperatures by causing cooling-water to flow the cooling chambers of the tuyere body and the cooling chamber of the tuyere nose at high pressure and high flowing speed. On the other hand, in the case wherein melted hot metal or slag having a more thermal capacity than cooling capability contacts the tuyere, the directly contacted portion is the shell layer having a high melting point and the tuyere trunk made of Cu is isolated. Therefore, this trunk made of Cu can always be kept below its melting point. In this way, the tuyere can be prevented from failure by synergism of the cooling effect of the cooing-water and the heat resistance effect by the shell layer.

Incidentally, it is desired that a material constituting the shell layer is a ceramic having a high resistance against hot metal or slag. If the tuyere trunk is coated with, for example, highly purified alumina as described above, it has resistance up to high temperate of about 2000° C. This highly purified alumina is also preferred from the standpoint that the alumina, together with Cu of the tuyere trunk, does not produce any low melting point alloy. The disadvantage of the tuyere coated with the ceramic shell layer is however in that it is brittle against mechanical impacts and in that, in particular at the time of inserting and fitting the tuyere into a blast furnace, mechanical impacts are applied to the tuyere and the ceramic is easily damaged so that cracks are generated or partial exfoliation arises. As a result, the heat resistance effect is lost so that the inner Cu layer will fail for a short period.

On the other hand, in the present invention the jacket made of a metal is fitted onto the outside of the shell layer. Accordingly, the mechanical impacts received at the time of inserting the tuyere into a blast furnace do not affect the shell layer directly so that the function of protecting the shell layer from the impacts becomes satisfactory. The material of the jacket is desirably Cu. However, a metal resisting against the inevitable mechanical impacts at the time of the insertion of the tuyere is allowable even if the metal is not Cu. It is also entirely allowable that the jacket made of a metal is lost by melting or the like during operation after the insertion.

In the present invention, the shell layer and the jacket may be fitted to only the upper half of the tuyere trunk. When it is fully feared that the lower half of the tuyere trunk is mechanically or thermally damaged at the time of the insertion and any operation, it is desired that they are fitted onto the whole of the outer circumference surface of the portion projected into a blast furnace.

Furthermore, a preferred embodiment of the present invention has a structure wherein studs are scattered and disposed on the outer circumference surface of the portion being in the tuyere trunk and contacting the shell layer, or a slightly uneven surface is formed. By such a structure, the adhesion between the Cu portion of the tuyere trunk and the shell layer becomes secure, so that the shell layer will not peel off under severe use-conditions during operation or the like. Thus, the life span of the tuyere is made far longer.

PREFERRED EMBODIMENTS OF THE INVENTION

Figure 1:
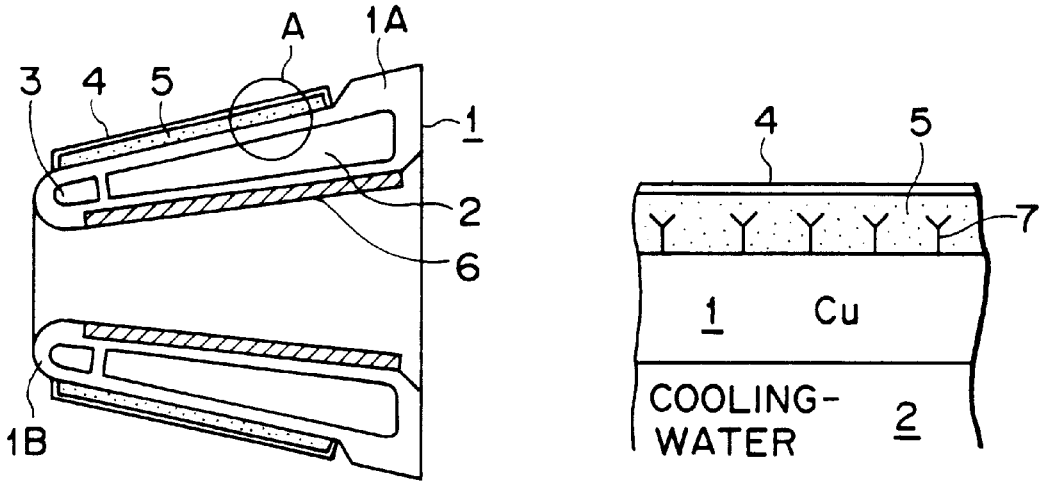
FIG. 1A is a cross section of a tuyere according to a first embodiment of the present invention.
FIG. 1B is a view illustrating an enlarged, encircled A area in FIG. 1A.

Referring to the attached drawings, preferred embodiments of the present invention will be specifically described hereinafter.

FIG. 1A illustrates a section of a tuyere according to a first embodiment of the present invention. FIG. 1B illustrates an enlarged, encircled A area in FIG. 1A. In the tuyere illustrated in FIG. 1A, a tuyere trunk 1 composed of a tuyere body 1A (body chamber) and a tuyere nose 1B (nose chamber) is made of Cu, and constitutes a tuyere called "nozzle type tuyere". In the tuyere trunk 1, a circular flowing route for cooling-water for cooling the tuyere is formed so as to include cooling chambers 2 of the tuyere body, which chambers arranged to divide the tuyere body 1A equally along its circumferential direction, and a cooling chamber 3 in a ring form in the nose 1B. Although details of the structure of the circular flowing route, such as a connecting mouth, are not illustrated, the flowing route is formed, for example, in such a manner as follows: the cooling-water is introduced from a water supply mouth at the base side (the right side in FIG. 1A) of the tuyere trunk 1 into half of the cooling chambers 2 of the tuyere body, which chambers are alternated, and diffuses and advances to cool the substantial half of the tuyere trunk 1A; next this cooling-water is, through the connecting mouth, introduced into the cooling chamber 3 of the tuyere nose and makes a circuit of this chamber 3 at high pressure and high flowing rate to cool the tuyere nose 1B; subsequently the cooling-water is, through another connecting mouth, introduced into the remaining half of the cooling chambers 2 of the tuyere body, and diffuses and advances to cool the substantial half of the tuyere body 1A; and at last the cooling-water flows out from a drainage mouth at the base side of the tuyere trunk 1. Thus, the tuyere trunk 1 is intensely cooled by the cooling-water at high pressure and high flowing rate, so as to prevent tuyere failure. Usually, the pressure of the cooling-water is set to 20 $kg/cm^2G$ or more, and the flowing rate is set to 15 m/s.

In the tuyere trunk 1 made of Cu, the outer circumference surface of the portion projected into the furnace is coated with a shell layer 5 made of, for example, a ceramic such as a highly purified ceramic. Additionally, a jacket 4 made of a metal is fitted to the outside of the shell layer 5. Thus, the portion of the tuyere, which portion projects into the furnace, is a three-layer structure wherein the Cu layer, the shell layer 5 and the jacket 4 are arranged in turn from the inside of this portion.

The embodiment illustrated in FIG. 1 is an example wherein the whole, excluding the forefront portion, of the outer circumference surface of the portion projected into the furnace is coated with the shell layer 5. In some furnace wherein a tuyere is installed, however, a hot metal in the furnace does not contact the lower half of the outer circumference surface, and in such a case it is sufficient that only the upper half of the outer circumference surface is coated with the shell layer 5. Correspondingly to this, it is sufficient that the jacket 4 is fitted onto only the upper half of the outer circumference surface.

A preferable manner for fitting the shell layer 5 and the jacket 4 is to fit a cylindrical or semi-cylindrical jacket 4 made of a metal, for example, Cu, onto the outer circumference surface of the body of the tuyere trunk 1 in the state that an about 5–10 mm gap is kept and then fill a ceramic into the gap in a casting way. In this case, the ceramic can be surely and easily filled by making an opening for casting a ceramic at the lower side of one end of the jacket 4 and a pressure releasing opening at the upper side of the other end, and introducing the ceramic into the casting opening by pressure until the ceramic overflows from the pressure releasing opening. Preferable examples of this ceramic include a cement-form kneaded ceramic wherein the composition ratio is: $Al_2O_3$:75%, SiC:17% and $SiO_2$:4%. On the other hand, the raw material of the jacket 4 is preferably Cu. However, any metal able to resist mechanical impacts at the time of inserting the tuyere into a furnace can be used regardless of the kind thereof. A material may be used which disappears without its original form being retained by melting after installment thereof into a predetermined position of the furnace.

The present embodiment has a structure wherein studs 7 are scattered and disposed on the outer circumference surface of the body of the tuyere trunk 1, in order to improve adhesion between the Cu portion of the tuyere trunk 1 and the shell layer 5. The studs 7 function similarly to pillars. From the standpoint of enlarging the contact area between the studs 7 and the ceramic of the shell layer 5, in the illustrated embodiment metal lines made of Cu, Fe or the like and made into a character "Y" form are dispersed and erected on the outer surface of the tuyere body. Besides, spiral metal lines may also be used.

In this embodiment, a castering 6 made from a refractory material by cast molding is further fitted onto the inner wall of the tuyere, so as to form a tuyere having a heat-resistance and impact-resistance structure capable of preventing wear damage of the inner surface of the tuyere.

Figure 2:
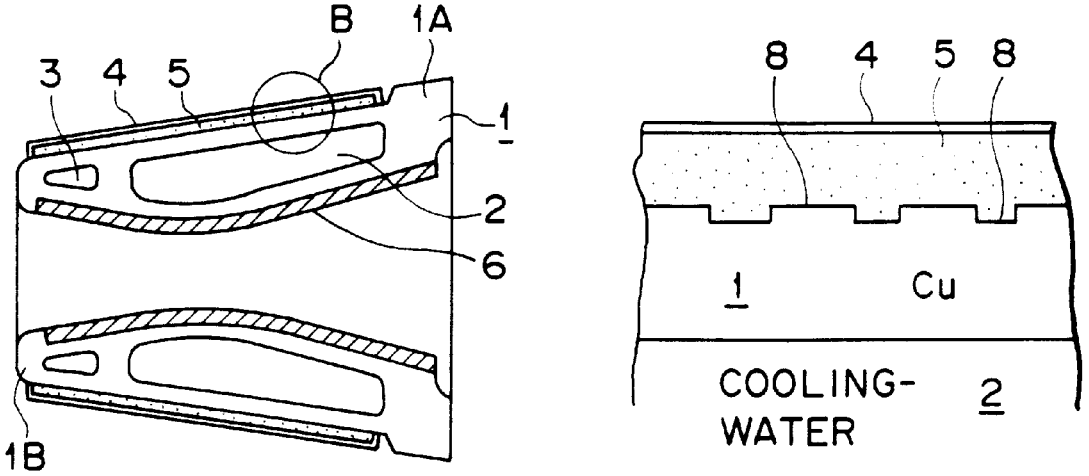
FIG. 2A is a view illustrating a cross section of a tuyere according to a second embodiment of the present invention.
FIG. 2B is a view illustrating an enlarged, encircled B area in FIG. 2A.

FIG. 2A illustrates a section of a tuyere according to a second embodiment of the present invention. FIG. 2B illustrates an enlarged, encircled B area in FIG. 2A. The tuyere according to the second embodiment, illustrated in FIG. 2A, is similar to the first embodiment. Thus, the same reference numbers are attached to the corresponding members, and the same detailed explanation is omitted.

The illustrated tuyere according to the second embodiment is a so-called Laval nozzle type of furnace tuyere where a nozzle type tuyere and a diffuser type tuyere are combined. Its basic structure and blast characteristic are known. The shell 5, the jacket 4 and the castering 6 based on the same structures as the first embodiment are fitted to this Laval nozzle type of furnace tuyere. Of course, therefore, their effects and advantages are exhibited in the same way as in the first embodiment.

As illustrated in FIG. 2B, the second embodiment has a structure wherein the outer circumference surface of the body of the tuyere trunk 1 is formed into a slightly uneven surface 8, in order to improve the adhesion between the Cu portion of the tuyere trunk 1 and the shell layer 5. In the illustrated embodiment, the uneven surface 8 is formed by digging, in parallel, shallow and ring-like grooves crossing the axis of the outer circumference surface of the tuyere body. Besides, however, various uneven surfaces 8 having, for example, unevenness in a button form or checked unevenness, may be processed.

Figure 3:
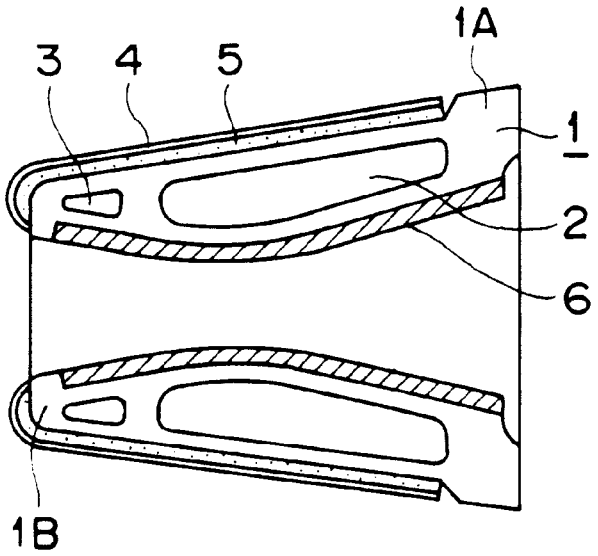
FIG. 3 is a cross section of a tuyere according to a third embodiment of the present invention.

FIG. 3 illustrates a section of a tuyere according to a third embodiment of the present invention. This tuyere according to the third embodiment, illustrated in FIG. 3, is similar to the second embodiment. Thus, the same reference numbers are attached to the corresponding members, and the same detailed explanation is omitted.

The structure of the illustrated third embodiment is characterized in that the jacket 4 and the shell layer 5 are formed over at least the upper half of the whole of the outer circumference surface of the portion being in the tuyere trunk 1, projecting into the blast furnace and including the forefront. (In the illustrated tuyere, they are formed over the whole of the outer circumference surface. ) That is, in the first and second embodiments the jacket 4 and the shell layer 5 are formed on at least the upper half of the portion excluding the forefront while in the present embodiment the outer circumference surface of the forefront is further coated with the shell layer 5 and the jacket 4 is also formed correspondingly to the shell layer 5. This makes it possible to prevent the forefront from failure by the hot metal or slag. Other structures and effects are the same as the first and second embodiments.

According to the respective embodiments having such structures, concerning the outer surface of the tuyere body the tuyere failure caused by the drop of hot metal or slag can be certainly prevented by forming the shell layer 5, and concerning the inner surface of the tuyere body wear damage caused by collision with very fine coal can be prevented by forming the castering 6. Additionally superheat of the tuyere trunk 1 can be suppressed by insulation effect of the castering 6 itself. According to the third embodiment, the forefront is also coated with the shell layer 5, and thus direct adhesion of dragged hot metal or slag to the Cu portion is prevented so as not to cause tuyere failure. Besides, wear of the forefront of the tuyere by raceway coke can also be prevented. In the first and second embodiments, the forefront of the tuyere can be protected by using conventional hard-facing means, for example, means for applying hard-facing of a Ni—Cr layer.

Figure 4:
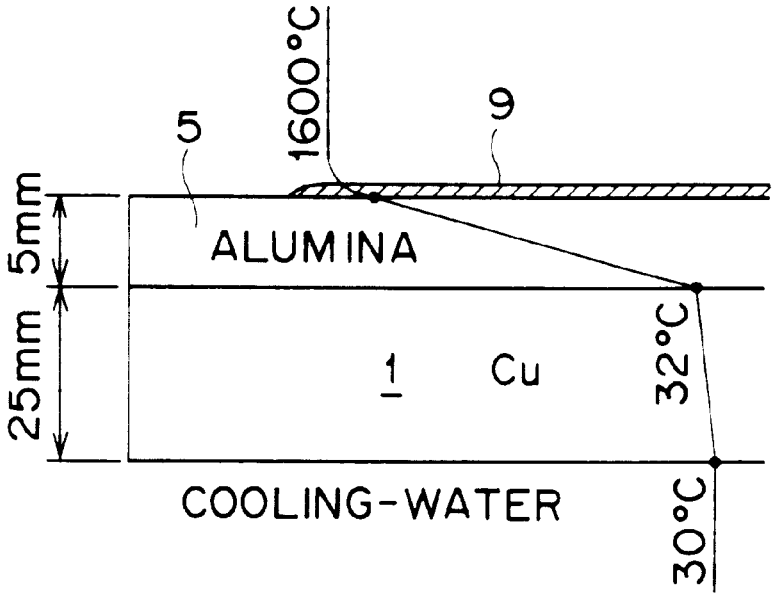
FIG. 4 is a partial cross section of a tuyere according to an embodiment of the present invention, wherein a temperature gradient line is also drawn.

FIG. 4 illustrates a partial section of a tuyere according to an embodiment of the present invention, wherein a temperature gradient line is also drawn. On the assumption that the thermal conductivity of the Cu portion (thickness: 25 mm) of the tuyere trunk 1 made of Cu is 300 kcal/m hr deg, the thermal conductivity of alumina (thickness: 5 mm) of the shell layer 5 is 1.20 kcal/m hr deg, the outside jacket 4 made of a metal is lost, the temperature of the tuyere cooling-water is 30° C., the water-flowing speed is 15 m/s and the temperature of a hot metal 9 dropping on alumina of the shell layer 5 is 1600° C., the dynamic state of thermal transmission is calculated as follows: the temperature in the boundary between the Cu portion of the tuyere trunk 1 and the shell layer 5 made of alumina is 32° C. As is clear from this result, tuyere failure can surely be prevented by the present invention.

The present invention is carried out in such an embodiment as described above, and exhibits advantageous effects described hereinafter. Namely, the present invention has a structure wherein a blast tuyere of a blast furnace, comprises a tuyere trunk having a cooling chamber of a tuyere body and a cooling chamber of a tuyere nose; at least the upper half of the whole of the outer circumference surface of a portion being in said tuyere trunk and projecting into said blast furnace, or the whole excluding the forefront of said outer circumference surface is coated with a shell layer made of a material having a higher melting point than the melting point of Cu and temperature of a hot metal in said blast furnace; and a jacket made of a metal for protecting said tuyere from mechanical impacts received at the time of inserting said tuyere into said blast furnace is fitted onto the outside of said shell layer. Therefore, the present invention makes it possible to prevent the tuyere from failure caused by high temperature in a blast furnace and makes its life span longer by synergism of intensive cooling effect by cooling-water passing through the respective cooling chambers and heat resistance effect of the shell layer made of a material having a high melting point.

In the present invention, the tuyere trunk made of Cu is coated with the shell layer having a high melting point. Thus, even if melted hot metal or slag having a more thermal capacity than cooling capability contacts the tuyere in a blast furnace, the Cu portion does not bring into contact with the melted hot metal or slag so that the temperature of the Cu portion can be kept low to be its melting point or lower. Accordingly, the tuyere can be prevented from failure before it happens. Moreover, since the jacket made of a metal is fitted onto the outside of the shell layer, mechanical impacts received at the time of inserting the tuyere in a blast furnace do not affect the shell layer directly. Thus, the function of protecting the shell layer from the impacts becomes sufficient, and the original heat resistance function of the shell layer can stably be exhibited for a long time, as initially designed.

What is claimed is:

1. A blast tuyere of a blast furnace, comprising:

a tuyere trunk having a tuyere body and a tuyere nose said tuyere body and tuyere nose each having a cooling chamber, at least the upper half of the outer surface of a portion of said tuyere trunk projecting into said blast furnace being coated with a shell layer made of a material having a higher melting point than the melting point of Cu and higher than the temperature of a hot metal in said blast furnace, and a metal jacket fitted onto the outside of said shell layer.

2. A blast tuyere of a blast furnace according to claim 1, wherein said shell layer is made of a ceramic having a high resistance against hot metal or slag.

3. A blast tuyere of a blast furnace according to claim 2, wherein said shell layer is made of highly purified alumina.

4. A blast tuyere of a blast furnace according to claim 2, wherein said shell layer has a thickness of 5–10 mm.

5. A blast tuyere of a blast furnace according to claim 3, wherein said shell layer has a thickness of 5–10 mm.

6. A blast tuyere of a blast furnace according to claim 1, wherein studs for improving adhesion between said tuyere trunk and said shell layer are disposed on the outer surface having said shell layer thereon.

7. A blast tuyere of a blast furnace according to claim 2, wherein studs for improving adhesion between said tuyere trunk and said shell layer are disposed on the outer surface having said shell layer thereon.

8. A blast tuyere of a blast furnace according to claim 3, wherein studs for improving adhesion between said tuyere trunk and said shell layer are disposed on the outer surface having said shell layer thereon.

9. A blast tuyere of a blast furnace according to claim 1, wherein a slightly uneven surface for improving adhesion between said tuyere trunk and said shell layer is formed as the outer surface having said shell layer thereon.

10. A blast tuyere of a blast furnace according to claim 2, wherein a slightly uneven surface for improving adhesion between said tuyere trunk and said shell layer is formed as the outer surface having said shell layer thereon.

11. A blast tuyere of a blast furnace according to claim 3, wherein a slightly uneven surface for improving adhesion between said tuyere trunk and said shell layer is formed as the outer surface having said shell layer thereon.

* * * * *